US006824082B2

(12) United States Patent
Ricco et al.

(10) Patent No.: US 6,824,082 B2
(45) Date of Patent: Nov. 30, 2004

(54) METHOD OF PRODUCING A FUEL INJECTOR, AND RELATIVE FUEL INJECTOR

(75) Inventors: Mario Ricco, Casamassima (IT); Adriano Gorgoglione, Modugno (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 377 days.

(21) Appl. No.: 10/034,631

(22) Filed: Dec. 28, 2001

(65) Prior Publication Data

US 2002/0125344 A1 Sep. 12, 2002

(30) Foreign Application Priority Data

Dec. 29, 2000 (IT) ..... TO2000A1230
Jan. 16, 2001 (IT) ..... TO2001A0025

(51) Int. Cl.[7] ..... F02M 39/00

(52) U.S. Cl. ..... 239/533.3; 239/533.2; 239/583

(58) Field of Search ..... 62/533.3, 533.2, 62/583, 584, 88, 96; 123/294, 527, 525, 529

(56) References Cited

U.S. PATENT DOCUMENTS 4,631,973 A 12/1986 Eley ..... 74/439
4,635,853 A 1/1987 Mowbray ..... 239/533.3
4,790,055 A * 12/1988 Raufeisen et al. ..... 29/888.46
4,938,193 A * 7/1990 Raufeisen et al. ..... 123/470

FOREIGN PATENT DOCUMENTS

EP 0890729 1/1999

* cited by examiner

*Primary Examiner*—Chen Wen Jiang
(74) *Attorney, Agent, or Firm*—Ladas & Parry

(57) ABSTRACT

A fuel injector has an injector body extending along a given axis; a tubular valve body housed inside a hole in the injector body and coaxial with the injector body; and an annular chamber defined by the injector body and the valve body. The method of producing the injector includes connecting the valve body to the injector body, and fixing the valve body in a given position along the axis with respect to the injector body by means of a driving operation to interference fit the valve body inside the hole in the injector body.

7 Claims, 2 Drawing Sheets

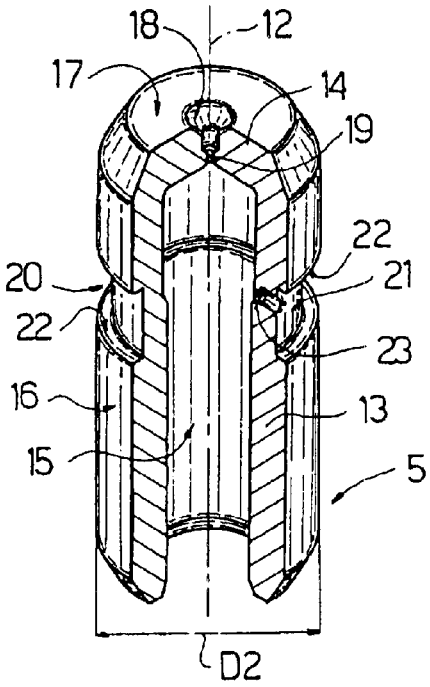
Fig.2
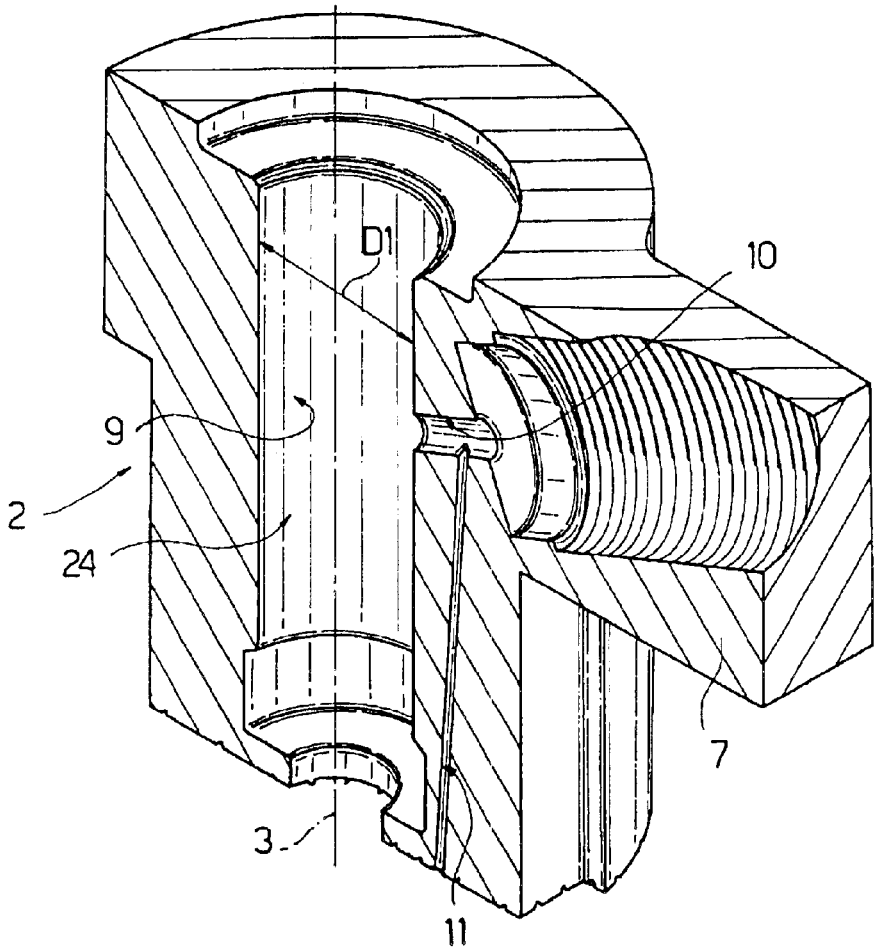

METHOD OF PRODUCING A FUEL INJECTOR, AND RELATIVE FUEL INJECTOR

The present invention relates to a fuel injector.

More specifically, the present invention relates to a fuel injector for an internal combustion engine, to which the following description refers purely by way of example.

BACKGROUND OF THE INVENTION

A known internal combustion engine fuel injector comprises a tubular injector body extending along a given axis; and a valve housed in a seat in the injector body and comprising a tubular valve body fixed inside the injector body seat and coaxial with the injector body. The injector has an annular chamber defined by the injector body and the valve body, which have respective annular shoulders separated by a given distance equal to the height of the annular chamber.

To form the injector, the valve body is fixed to the injector body in a given position along the axis by means of further shoulders formed on the valve and injector bodies and resting against each other, and by means of a ring nut which engages a threaded portion of the injector body and pushes the valve body axially against the injector body to keep the further shoulders in contact with each other. The injector also comprises a seal housed inside the annular chamber to prevent the high-pressure fuel fed into the annular chamber from leaking between the injector body and the valve body.

The method of producing the above injector comprises forming shoulders on the injector body and valve body to form the annular chamber; threading a portion of the injector body; forming further shoulders on the valve body and injector body to define a given axial position of the valve body with respect to the injector body; and assembling a seal and ring nut.

SUMMARY OF THE INVENTION

It is an object of the present invention to provide a particularly fast method of producing an injector.

According to the present invention, there is provided a method of producing a fuel injector comprising a tubular injector body extending along a given axis; a tubular valve body housed inside a seat in the injector body and coaxial with the injector body; and an annular chamber defined by the injector body and the valve body; the method comprising connecting the valve body to the injector body, and fixing the valve body to the injector body in a given position along the axis; and the method being characterized in that the valve body is connected and fixed to the injector body by means of a driving operation to interference fit the valve body inside the seat in the injector body.

Interference fitting the valve body inside the seat in the injector body enables the valve body to be fixed in a given axial position with respect to the injector body without machining further shoulders or the thread, and with no need for a ring nut, and also ensures hermetic sealing between the valve body and the injector body, so that the seal inside the annular chamber, between the valve body and the injector body, for sealing the annular chamber can be dispensed with.

Eliminating machining and reducing the number of component parts of the injector enable the injector to be produced extremely quickly.

In one particular embodiment, the method comprises forming an annular groove on said valve body; said groove interrupting the outer cylindrical face of the valve body and defining said annular chamber together with the inner face of said seat.

The size of the annular chamber is defined solely by formation of the groove, and does not depend on the axial position of the valve body with respect to the injector body; and the forces generated by the fuel pressure are balanced along said given axis, unlike known injectors in which the axial forces are not balanced and any loosening of the ring nut alters the size of the annular chamber.

The present invention also relates to an injector.

According to the present invention, there is provided an injector comprising a tubular injector body extending along a given axis; a tubular valve body housed inside a seat in the injector body and coaxial with the injector body; and an annular chamber defined by the injector body and the valve body; the injector being characterized in that the valve body is fixed to the injector body by means of a driving operation to interference fit the valve body inside the seat in the injector body.

BRIEF DESCRIPTION OF THE DRAWINGS

A non-limiting embodiment of the present invention will be described by way of example with reference to the accompanying drawings, in which:

FIG. 2 shows an exploded view, with parts in section and parts removed for clarity, of two component parts of the FIG. 1 injector.

DETAILED DESCRIPTION OF THE INVENTION

Figure 1:
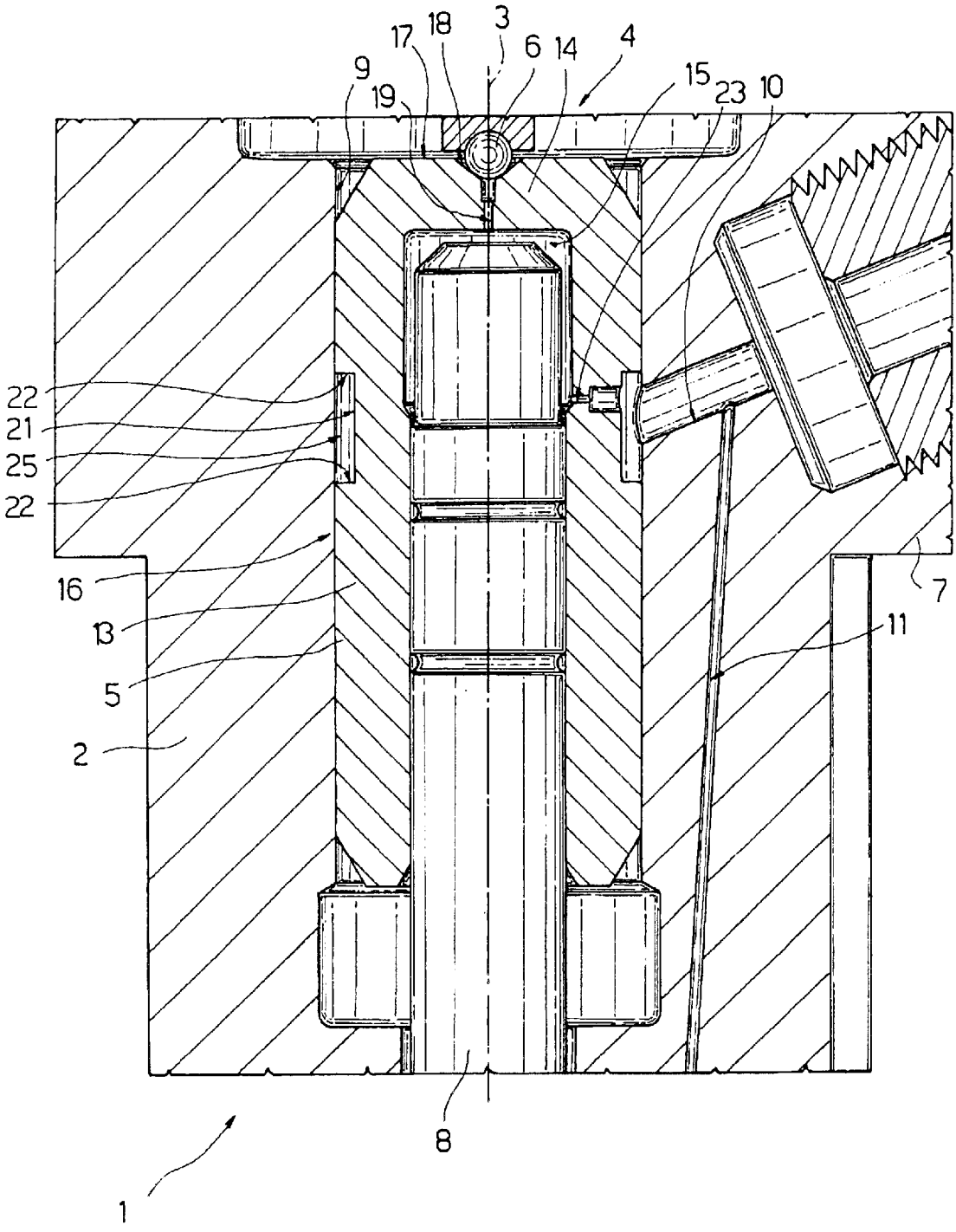
FIG. 1 shows a section, with parts removed for clarity, of an injector produced using the method according to the present invention.

Number 1 in FIG. 1 indicates as a whole a fuel injector for internal combustion engines.

Injector 1 comprises a tubular injector body 2 having an axis 3; and a valve 4 in turn comprising a valve body 5 fixed inside a seat in injector body 2, and a shutter 6. Hereinafter, both the axis of injector 2 and the axis of injector 1, being coincident, are referred to as axis 3. Injector 1 has a fitting 7 for connecting injector 1 to a high-pressure fuel supply conduit (not shown in FIG. 1); and a rod 8 sliding inside valve body 5. With reference to FIG. 2, injector body 2 comprises a hole 9 coaxial with axis 3, of a diameter D1, and defining said seat for housing valve body 5; a hole 10 crosswise to axis 3 and connecting hole 9 to fitting 7; and a hole 11 extending inside injector body 2, alongside hole 9, from hole 10 to a nozzle (not shown) at one end of injector body 2, to feed high-pressure fuel to the nozzle.

With reference to FIG. 2, valve body 5 is tubular and has an axis 12, a cylindrical lateral wall 13, and an end wall 14 perpendicular to axis 12. Walls 13 and 14 define a substantially cylindrical seat 15 for housing one end of rod 8, as shown in FIG. 1. In FIG. 2, lateral wall 13 has a cylindrical outer face 16 of diameter D2, and end wall 14 has an annular outer face 17 about a truncated-cone-shaped seat 18 for housing shutter 6. Valve body 5 comprises a nozzle 19, which is formed through end wall 14, is coaxial with axis 12, and connects seat 15 to seat 18, which is also coaxial with axis 12.

Cylindrical wall 13 has an annular groove 20, which divides outer face 16 into two distinct portions, and which comprises a cylindrical face 21 parallel to outer face 16, and two facing annular faces 22 perpendicular to axis 12. Valve body 5 comprises a nozzle 23, which is formed in cylindrical wall 13, at groove 20, is perpendicular to axis 12, and connects groove 20 to seat 15.

Depending on the application of injector 1, diameter D2 ranges between 6 and 8 mm and is greater than diameter D1 by an interference value ranging between 10 and 20 microns.

Injector body 2 is formed by means of known machining operations, and hole 9 is ground to form an inner cylindrical face 24 of hole 9 with a tolerance ranging between +0 and +0.005 mm. In substantially the same way, valve body 5 is formed by means of known machining operations, and is ground along outer face 16 to obtain a cylindrical surface with a tolerance ranging between +0.015 and +0.020 mm.

Injector body 2 is then heated, and a respective valve body 5 simultaneously cooled, e.g. using liquid nitrogen. Once heated and cooled respectively, injector body 2 and respective valve body 5 are aligned along respective axes 3 and 12, and, by means of a known press (not shown), valve body 5 is driven inside hole 9 into a given position along axis 3 of injector body 2, as shown in FIG. 1. With valve body 5 in said given position, groove 20 is located at hole 10 and defines, with inner face 24 of hole 9, an annular chamber 25. In other words, annular chamber 25 is defined by cylindrical face 21 and annular faces 22 of groove 20, and by a portion of face 24 of hole 9. The interference fit between injector body 2 and valve body 5 prevents high-pressure fuel leakage from chamber 25 with no seals required between injector body 2 and valve body 5.

The interference fit described improves sealing and the working life of injector 1 as compared with known seals, which tend to be drawn between the valve body and injector body of known injectors when subjected to over a thousand-bar working pressure.

What is claimed is:

1. In a fuel injector, the improvements comprising:

a tubular injector body (2) extending along a given axis (3);

a tubular valve body (5) housed inside a seat (9) in the injector body (2) and coaxial with the injector body (2), the valve body (5) being sealingly fixed to the injector body (2) by interference fit; and an annular chamber (25) defined by the injector body (2) and the valve body (5) within the interference fit for supplying the fuel from the tubular injector body (2) into the tubular valve body (5).

2. An injector as claimed in claim 1, characterized in that said seat (9) is a hole (9) having a cylindrical inner face (24) with a given first diameter (D1); and in that the valve body (5) has a cylindrical outer face (16) with a given second diameter (D2).

3. An injector as claimed in claim 2, characterized in that the interference between the second diameter (D2) and the first diameter (D1) is 10 to 20 microns.

4. An injector as claimed in claim 3, characterized in that said valve body (5) has an annular groove (20) dividing said cylindrical outer face (16); said annular chamber (25) being defined by the annular groove (20) and by a portion of the cylindrical inner face (24) of the injector body (2).

5. An injector as claimed in claim 4, characterized in that said annular groove (20) comprises a cylindrical first face (21) parallel to the cylindrical outer face (16) of the valve body (5); and two annular second faces (22) on opposite sides of the cylindrical first face (21).

6. An injector as claimed in claim 5, characterized in that each annular second face (22) is perpendicular to said given axis (3), and extends from the cylindrical first face (21) of the annular groove (20) to the cylindrical outer face (24) of the injector body (2).

7. An injector as claimed in claim 1, characterized in that the cylindrical inner face (24) of the hole (9) and the cylindrical outer face (16) of the valve body (5) are ground.

* * * * *